US010428412B2

(12) United States Patent
Harrison et al.

(10) Patent No.: US 10,428,412 B2
(45) Date of Patent: Oct. 1, 2019

(54) ARTIFICIAL AGING OF STRAINED SHEET METAL FOR STRENGTH UNIFORMITY

(71) Applicant: Ford Motor Company, Dearborn, MI (US)

(72) Inventors: Nia R. Harrison, Ann Arbor, MI (US); Mikhail Minevich, Southfield, MI (US); S. George Luckey, Jr., Dearborn, MI (US)

(73) Assignee: FORD MOTOR COMPANY, Dearborn, MI (US)

( * ) Notice: Subject to any disclaimer, the term of this patent is extended or adjusted under 35 U.S.C. 154(b) by 227 days.

(21) Appl. No.: 15/343,629

(22) Filed: Nov. 4, 2016

(65) Prior Publication Data

US 2018/0127860 A1 May 10, 2018

(51) Int. Cl.
*C22F 1/05* (2006.01)

(52) U.S. Cl.
CPC ..... *C22F 1/05* (2013.01)

(58) Field of Classification Search
CPC .. C22F 1/04; C22F 1/046; C22F 1/047; C22F 1/05; C22F 1/053; C22F 1/057
See application file for complete search history.

(56) References Cited

U.S. PATENT DOCUMENTS 3,899,370 A 8/1975 Takahashi et al.
5,582,660 A 12/1996 Erickson et al.
5,690,758 A * 11/1997 Oh ..... C22F 1/05 148/694
6,406,571 B1 6/2002 Gupta et al.
7,018,489 B2 3/2006 Bennon et al.
7,029,543 B2 4/2006 Bull et al.
8,636,855 B2 1/2014 Wang et al.
8,721,811 B2 5/2014 Lin et al.
2002/0017344 A1 2/2002 Gupta et al.
2002/0121319 A1 9/2002 Chakrabarti et al.
2004/0140026 A1 * 7/2004 Kamat ..... C22F 1/04 148/698

(Continued)

FOREIGN PATENT DOCUMENTS

CN 102134671 A 7/2011
DE 102011105447 A1 12/2012
KR 101147952 B1 5/2012

*Primary Examiner* — Colleen P Dunn
*Assistant Examiner* — Jeremy C Jones
(74) *Attorney, Agent, or Firm* — Ray Coppiellie; Brooks Kushman P.C.

(57) ABSTRACT

Methods of heat treating aluminum alloys are disclosed. The method may include forming a sheet of solution heat-treated, quenched, and aged 6xxx series aluminum having a sheet average yield strength of at least 100 MPa into a component. The component may then be attached to an assembly and at least a portion of the assembly may be painted. The method may then include heat treating the assembly to cure the paint and to increase a component average yield to at least 240 MPa. In another embodiment, the method may include progressively forging a sheet of T4-tempered 6xxx series aluminum into a component using multiple dies and artificially aging the component at 210° C. to 240° C. for 20 to 40 minutes to a component average yield strength of at least 300 MPa. The methods may reduce component cycle time and may reduce strength gradients within the component.

20 Claims, 6 Drawing Sheets

(56) References Cited

U.S. PATENT DOCUMENTS

| | | | | |
|---|---|---|---|---|
| 2005/0028894 | A1* | 2/2005 | Hoffmann | C22C 21/02 148/417 |
| 2005/0076977 | A1* | 4/2005 | Lumley | C22F 1/04 148/698 |
| 2005/0211350 | A1 | 9/2005 | Unal et al. | |
| 2006/0000094 | A1* | 1/2006 | Garesche | B21K 1/38 29/894.353 |
| 2012/0152416 | A1 | 6/2012 | Foster et al. | |
| 2013/0319585 | A1 | 12/2013 | Parson et al. | |
| 2014/0366998 | A1* | 12/2014 | Kamat | C22C 21/08 148/551 |
| 2016/0160332 | A1 | 6/2016 | Kamat et al. | |
| 2016/0326619 | A1* | 11/2016 | Bassi | C22F 1/05 |

* cited by examiner

| | PROCESS 10 | | T4 FORGED | | PROCESS 100 | | PROCESS 200 | | |
|---|---|---|---|---|---|---|---|---|---|
| SPR LOCATION | AVG. HARDNESS (HRB) | CALCULATED YIELD STREN-GTH (MPa) | AVG. HARDNESS (HRB) | CALCULATED YIELD STREN-GTH (MPa) | AVG. HARDNESS (HRB) | CALCULATED YIELD STREN-GTH (MPa) | AVG. HARDNESS (HRB) | CALCULATED YIELD STREN-GTH (MPa) | |
| 1 | 20.0 | 155 | 38.1 | 239 | 44.6 | 270 | 60.4 | 344 | PROTRUSION REGION |
| 2 | 31.9 | 210 | 53.3 | 310 | 64.9 | 365 | 66.9 | 374 | |
| 3 | 35.1 | 225 | 49.5 | 293 | 60.9 | 346 | 61.5 | 348 | |
| 4 | 22.2 | 165 | 27.4 | 189 | 44.6 | 269 | 61.0 | 346 | BULK REGION |
| 5 | 27.5 | 190 | 26.6 | 185 | 45.3 | 273 | 61.3 | 347 | |
| 6 | 27.4 | 189 | 24.9 | 178 | 42.8 | 261 | 61.4 | 348 | |
| 7 | 29.8 | 200 | 23.7 | 172 | 41.7 | 256 | 60.5 | 344 | |
| 8 | 30.4 | 203 | 23.7 | 172 | 39.5 | 246 | 60.4 | 343 | |
| 9 | 33.4 | 217 | 25.1 | 178 | 42.7 | 261 | 59.5 | 339 | |
| 10 | 33.8 | 219 | 25.8 | 182 | 42.5 | 260 | 60.8 | 345 | |

| | | | | | | | | |
|---|---|---|---|---|---|---|---|---|
| AVERAGE: | 29.2 | 197 | 31.8 | 210 | 46.9 | 281 | 61.4 | 348 |
| ST. DEV: | 5.0 | 23 | 11.2 | 52 | 8.6 | 40 | 2.0 | 9 |
| AVG. PTS 1-3 | 29.0 | 197 | 47.0 | 281 | 56.8 | 327 | 62.9 | 355 |
| AVG. PTS 4-10 | 29.2 | 198 | 25.3 | 180 | 42.7 | 261 | 60.7 | 345 |

FIG. 9

| BRACKET MATERIAL | PROTRUSION | | | | BULK REGION | | |
|---|---|---|---|---|---|---|---|
| | MICROHARDNESS (VICKERS) AS MEASURED | | CALCULATED HARDNESS (HRB) CONVERTED FROM VICKERS | CALCULATED YIELD STRENGTH (MPa) W/R TO VICKERS MEASUREMENT | CALCULATED HARDNESS (HRB) AS MEASURED | | CALCULATED YIELD STRENGTH (MPA) W/R TO HRB MEASUREMENT |
| | AVERAGE | ST. DEV. | AVERAGE | AVERAGE | AVERAGE | ST. DEV. | AVERAGE |
| PROCESS 10 | 86.2 | 4.0 | 27.5 | 192 | 29.2 | 5.0 | 197 |
| T4 FORGED | 129.5 | 7.9 | 69.1 | 342 | 31.8 | 11.2 | 210 |
| PROCESS 100 | 136.4 | 6.9 | 73.7 | 366 | 47.0 | 8.6 | 281 |
| PROCESS 200 | 128.6 | 4.7 | 68.4 | 339 | 61.4 | 2.0 | 348 |

FIG. 10

ARTIFICIAL AGING OF STRAINED SHEET METAL FOR STRENGTH UNIFORMITY

TECHNICAL FIELD

The present disclosure relates to the artificial aging of strained sheet metal for strength uniformity, for example, for aluminum alloy vehicle components.

BACKGROUND

One approach to reducing vehicle weight in automotive design is with aluminum intensive vehicles (AIVs). AIVs have often been based on the unibody design of steel vehicle architectures, which are assemblies of stamped sheet metal components. Automotive AIV design has focused primarily on the 5XXX and 6XXX series aluminum sheet, as they can be shaped and processed by methods consistent with those already used in automotive manufacturing of steel sheet (e.g., sheet stamping, automated assembly, paint process). These alloys may have strengths equivalent to the mild steel sheet generally used in steel vehicle platforms. The 6XXX series aluminum alloys may experience improved mechanical strength properties when certain heat treatment processes are performed.

SUMMARY

In at least one embodiment, a method is provided. The method may include forming a sheet of solution heat-treated, quenched, and aged 6xxx series aluminum having a sheet average yield strength of at least 100 MPa into a component; attaching the component to an assembly; painting at least a portion of the assembly; and heat treating the assembly to cure the paint and to increase a component average yield to at least 240 MPa.

The sheet may have a T4 temper. In one embodiment, the forming step may include a progressive forging operation using multiple dies. The progressive forging operation may form a forged protrusion in the component and create a forging region surrounding the forged protrusion, the forging region being strained more than a bulk region of the component during the progressive forging. In one embodiment, the forged protrusion is frusto-conical and the forging region is a circle concentric with the frusto-conical forged protrusion. The heat treating step may increase an average yield strength of the forging region and the bulk region and reduce a strength gradient therebetween. The heat treating step may increase an average yield strength of the bulk region by a greater amount than the forging region.

In one embodiment, the heat treating step includes from 2 to 4 heat treatment cycles, each heat treatment cycle being at a temperature from 140° C. to 210° C. and lasting for 10 to 30 minutes. Each heat treatment cycle may be carried out at an oven temperature varying by only ±5° C. during an entire duration of the heat treatment. In one embodiment, the heat treating step consists of 3 heat treatment cycles: a first heat treatment at a temperature of 170° C. to 190° C. for 5 to 15 minutes; a second heat treatment at a temperature of 140° C. to 160° C. for 5 to 15 minutes; and a third heat treatment at a temperature of 130° C. to 150° C. for 5 to 15 minutes. The 6xxx series aluminum may have a composition profile including: 0.55-0.95 wt. % magnesium; 0.55-0.95 wt. % silicon; 0.5-0.8 wt. % copper; up to 0.3 wt. % manganese; up to 0.3 wt. % iron; up to 0.1 wt. % zinc; up to 0.1 wt. % chromium; and up to 0.1 wt. % titanium. In one embodiment, there are no additional artificial aging heat treatments between the forming step and the painting step.

In at least one embodiment, a method is provided. The method may include progressively forging a sheet of T4-tempered 6xxx series aluminum into a component using multiple dies; and artificially aging the component at 210° C. to 240° C. for 20 to 40 minutes to a component average yield strength of at least 300 MPa.

In one embodiment, the artificially aging step includes artificially aging the component at 220° C. to 230° C. for 25 to 35 minutes. The progressively forging step may include forming a forged protrusion in the component and creating a forging region surrounding the forged protrusion, the forging region being strained more than a bulk region of the component during the progressive forging. In one embodiment, the artificially aging step increases an average yield strength of the forging region and an average yield strength of the bulk region and reduces a strength gradient therebetween. The average yield strength of the bulk region may be within 15% or 5% of the average yield strength of the forging region. The average yield strengths of the bulk region and the forging region may be at least 320 MPa.

In at least one embodiment, a method is provided. The method may include progressively forging a sheet of T4-tempered 6xxx series aluminum into a component including a forged protrusion and a surrounding forging region; and heat treating the component to increase an average yield strength of the forging region and an average yield strength of a bulk region of the component and to reduce a strength gradient therebetween, the component having an average yield strength of at least 240 MPa after heat treating.

BRIEF DESCRIPTION OF THE DRAWINGS

FIG. 9 is a table of experimental strength and hardness data for various process flows for forming and heat treating aluminum alloy components; and FIG. 10 is a table comparing experimental strength and hardness data for various process flows in different regions of aluminum alloy components that have been forged.

DETAILED DESCRIPTION

Figure 1:
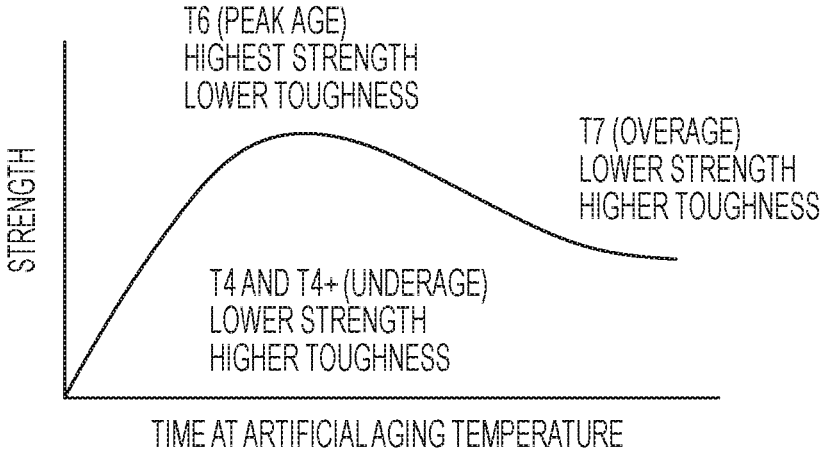
FIG. 1 is a schematic graph of strength versus artificial aging time showing several tempering stages of aluminum alloys.

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Aluminum alloys are generally identified by a four-digit number, wherein the first digit generally identifies the major alloying element. Additional numbers represented by the letter "x" in the series designation define the exact aluminum alloy. For example, the major alloying element of 5XXX series is magnesium and for 6XXX series they are magnesium and silicon. Examples of specific 6XXX series alloys may include 6061, which may have a composition including 0.4-0.8% silicon, up to 0.7% iron, 0.15-0.40% copper, up to 0.15% manganese, 0.8-1.2% magnesium, 0.04-0.35% chromium, up to 0.25% zinc, up to 0.15% titanium, and other elements up to 0.05% each (0.15% total), all percentages by weight with the balance being aluminum. Numerous automotive components may include 6061 aluminum, such as brackets, body components, fasteners, and others. Another specific example of a 6XXX series alloy may be 6111, which may have a composition including 0.5-1% magnesium, 0.6-1.1% silicon, 0.5-0.9% copper, 0.1-0.45% manganese, up to 0.4% iron, up to 0.15% zinc, up to 0.1% chromium, up to 0.1% titanium and other elements up to 0.05% each (0.15% total), all percentages by weight with the balance being aluminum. Numerous automotive components may include 6111 aluminum, such as body panels, pillars, and others. Components including 6111 aluminum may require higher yield strength than those including 6061 aluminum. Other specific 6XXX series alloys are known in the art, such as 6009, 6010, 6016, 6022, 6053, 6063, 6082, 6262, 6463, or others.

6XXX series aluminum alloys may be age hardened (precipitation hardened) to increase their strength and/or toughness. Age hardening is preceded by a solution heat treatment (SHT, or solutionizing) and quench of the aluminum alloy material. A solution treatment generally includes heating the alloy to at least above its solvus temperature and maintaining it at the elevated temperature until the alloy forms a homogeneous solid solution or a single solid phase and a liquid phase. The temperature at which the alloy is held during solutionizing is known as the solution temperature. The solution temperature may be the temperature at which a substance is readily miscible. Miscibility is the property of materials to mix in all proportions, forming a homogeneous solution. Miscibility may be possible in all phases; solid, liquid and gas.

Following the solution treatment, a quenching step is performed in which the alloy is rapidly cooled to below the solvus temperature to form a supersaturated solid solution. Due to the rapid cooling, the atoms in the alloy do not have time to diffuse long enough distances to form two or more phases in the alloy. The alloy is therefore in a non-equilibrium state. Quenching may be done by immersing the alloy in a quenching medium, such as water or oil, or otherwise applying the quenching medium (e.g., spraying). Quenching may also be accomplished by bringing the alloy into contact with a cooled surface, for example, a water-cooled plate or die. The quench rate may be any suitable rate to form a supersaturated solution in the quenched alloy. The quench rate may be determined in a certain temperature range, for example from 400° C. to 290° C. The quench may be performed until the alloy is at a cool enough temperature that the alloy stays in a supersaturated state (e.g., diffusion is significantly slowed), such as about 290° C. The alloy may then be air cooled or otherwise cooled at a rate slower than the quench rate until a desired temperature is reached. Alternatively, the quench may be performed to a lower temperature, such as below 100° C. or down to about room temperature.

Age hardening includes heating and maintaining the alloy at an elevated temperature at which there are two or more phases at equilibrium. The supersaturated alloy forms fine, dispersed precipitates throughout as a result of diffusion within the alloy. The precipitates begin as clusters of atoms, which then grow to form GP zones, which are on the order of a few nanometers in size and are generally crystallographically coherent with the surrounding metal matrix. As the GP zones grow in size, they become precipitates, which strengthen the alloy by impeding dislocation movement. Since the precipitates are very finely dispersed within the alloy, dislocations cannot move easily and must either go around or cut through the precipitates in order to propagate.

Five basic temper designations may be used for aluminum alloys which are; F—as fabricated, O—annealed, H—strain hardened, T—thermally treated, and W—as quenched (between solution heat treatment and artificial or natural aging). The as-received raw material for the disclosed solutionizing and age hardening processes may initially have any of the above temper designations. The temper designation may be followed by a single or double digit number for further delineation. An aluminum alloy with a T6 temper designation may be an alloy which has been solution heat treated and artificially aged, but not cold worked after the solution heat treatment (or such that cold working would not be recognizable in the material properties). T6 may represent the point of peak age yield strength along the yield strength vs. time and temperature profile for the material. A 6XXX series aluminum alloy having a T6 temper may have a yield strength of at least 220 MPa or 240 MPa, depending on the particular composition. For example, 6061 at a T6 temper may have a yield strength of about 275 MPa and 6111 at a T6 temper may have a yield strength of about 300 MPa. A T7 temper may designate that a solution heat treatment has occurred, and that the material was artificially aged beyond the peak age yield strength (over-aged) along the yield strength vs. time and temperature profile. A T7 temper material may have a lower yield strength than a T6 temper material, but the T7 temper may improve other properties, such as increased toughness compared to the T6 temper. A T8 temper is similar to a T7 temper in that it is aged beyond the peak yield strength (e.g., T6), however, a material with a T8 temper is artificially aged after the material has been cold worked. For example, sheets of 6111 alloy may be stamped in a T4 temper and then age hardened to T8, thereby forming a T8 temper.

With reference to FIG. 1, the relative strengths and toughnesses of 6XXX series aluminum alloys as a function of aging time are illustrated. As discussed above, T6 represents peak aging and the highest yield strength, while T7 represents over-aging and reduced (but still improved) yield strength. The T8 temper is not shown on the graph, but is similar to T7 in that it has lower yield strength than the T6 and lies to the right of the T6 peak-age. The T4 temper is shown to the left of peak aging, and may have properties similar to T7/8 (e.g., reduced strength and increased toughness relative to T6), but represents under-aging rather than over-aging. Under-aging the T4 temper, to a T4+, may be substituted for age hardening to T7 or T8 tempers in the present disclosure, however, under-aging may be more difficult to control and repeat. Therefore, over-aging may be a more robust and consistent process compared to under-aging.

T7 and T8 temper aluminum alloys (e.g., 6XXX and 7XXX) generally have increased bending toughness compared to the T6 temper. One method of measuring toughness may include determining the type of failure that a component exhibits after deformation. For example, when a sheet or coupon of material is bent to failure, the failure may be transgranular or intergranular. Transgranular failure, or failure across or through the grains of the alloy may indicate higher toughness than intergranular failure, where failure occurs along grain boundaries (e.g., between grains). Intergranular failure may occur when the grain boundaries are brittle or weak, which may be due to alloy composition, the type of heat treatment, or other factors (or a combination thereof). The T7 and T8 alloys disclosed herein may exhibit transgranular failure rather than intergranular failure during bending due to their increased toughness (e.g., compared to T6).

While the bending toughness of the T7 and T8 tempers may be greater than that of a T6 temper, a 6XXX series aluminum at a T7 or T8 temper may have a lower yield strength than a T6 temper due to over-aging. However, 6XXX series alloys age hardened according to the disclosed embodiments may maintain a yield strength of at least 200 MPa. For example, certain alloys (e.g., 6061) age hardened to a T7 or T8 temper (e.g., using the age hardening treatments described above) may have a yield strength of at least 200, 210, 220, 230, 240 MPa or higher. Some alloys (e.g., 6111) may have higher yield strengths following an age hardening heat treatment (e.g., as described above), for example, at least 250, 260, 270, 280, 290 MPa or higher.

Figure 2:
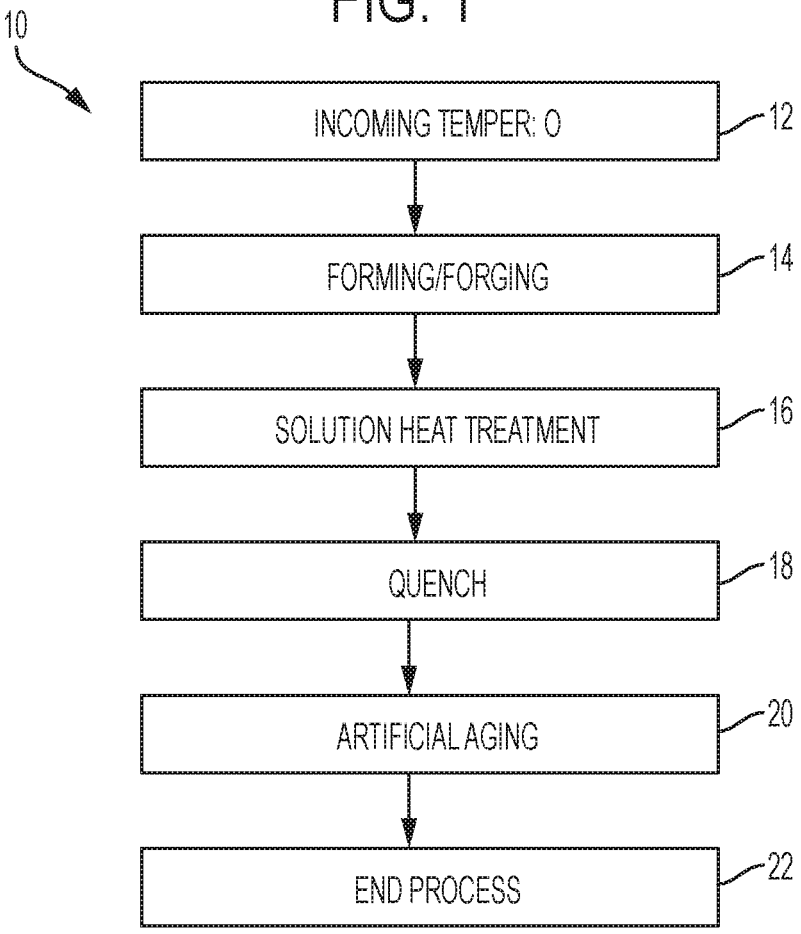
FIG. 2 is an example process flow for the forming and heat treating of an aluminum alloy component.

With reference to FIG. 2, a flowchart 10 is shown for a typical forming and heat treating process that may be used for aluminum components in a vehicle (e.g., a 6xxx series alloy). In step 12, an unformed component may be received or provided, such as a piece of aluminum sheet. The component may be in the O-temper, meaning it has been annealed. In step 14, the component may be formed into its final shape or near-final shape (e.g., except for finishing steps, such as trimming, grinding, or other machining). In one embodiment, the forming may be done by forging, for example, by stamping or by other uses of dies.

In step 16, the now-formed component may be solution heat treated such that the component is composed of a single phase (described above). In step 18, the component may be quenched in order to maintain the single phase by rapidly cooling the component. In step 20, the quenched component may be artificially aged in order to strengthen the component. As described above, artificial aging may cause precipitates to grow in the component which, may increase its strength and/or hardness. In step 22, the process may be completed except for finishing steps. After the process is ended, the component may be attached to other components during an assembly process (e.g., vehicle assembly) to form a finished product. The product may undergo a paint bake heat treatment process in order to cure or harden paint that has been applied during assembly/production.

The process 10 may be used to formed a variety of high-strength aluminum components. The components may be formed of aluminum sheet having a thickness of, for example, 0.5 to 5 mm, or any sub-range therein, such as 0.8 to 4 mm, 1 to 3.5 mm. As described above, the forming step 14 may include forging operations, which may include multiple steps. The forging operation may include performing successive operations using progressive dies (e.g., multiple dies with slight differences for each operation). One such process may be referred to as progressive stamping. Progressive forging may be used to form relatively complex components, such as components having multiple, non-coplanar mating surfaces.

Figure 3:
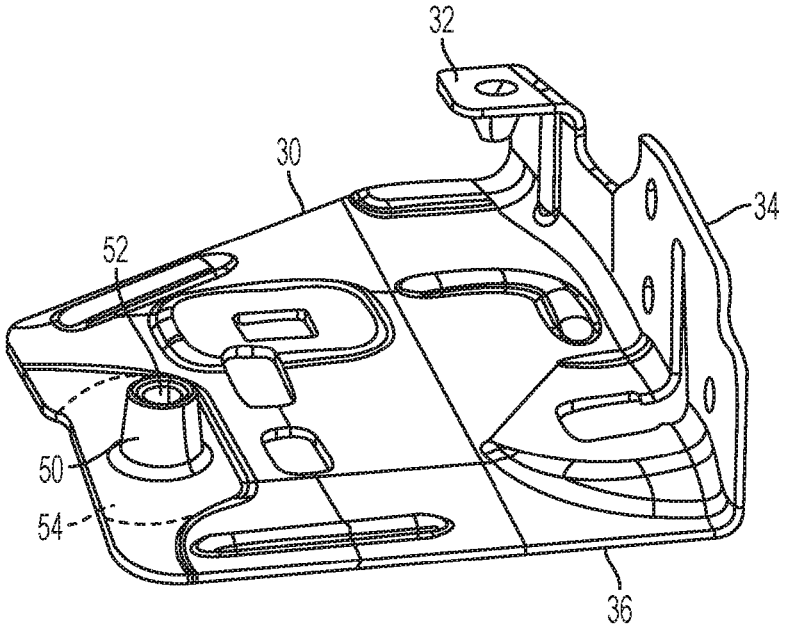
FIG. 3 is a front perspective view of a side door latch reinforcement component that may be produced according to the disclosed methods.
Figure 4:
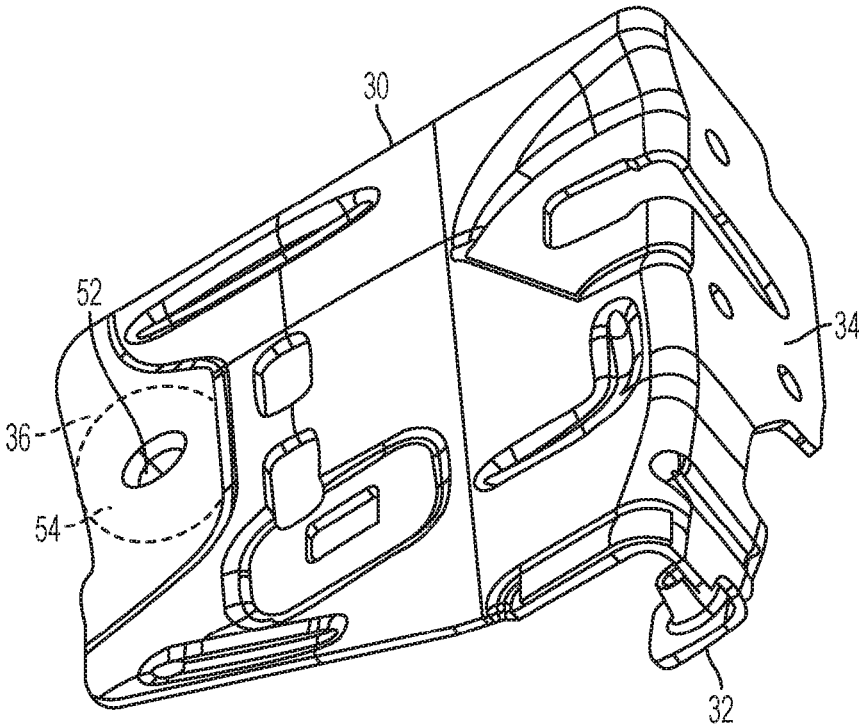
FIG. 4 is a rear perspective view the side door latch reinforcement component of FIG. 3.
Figure 5:
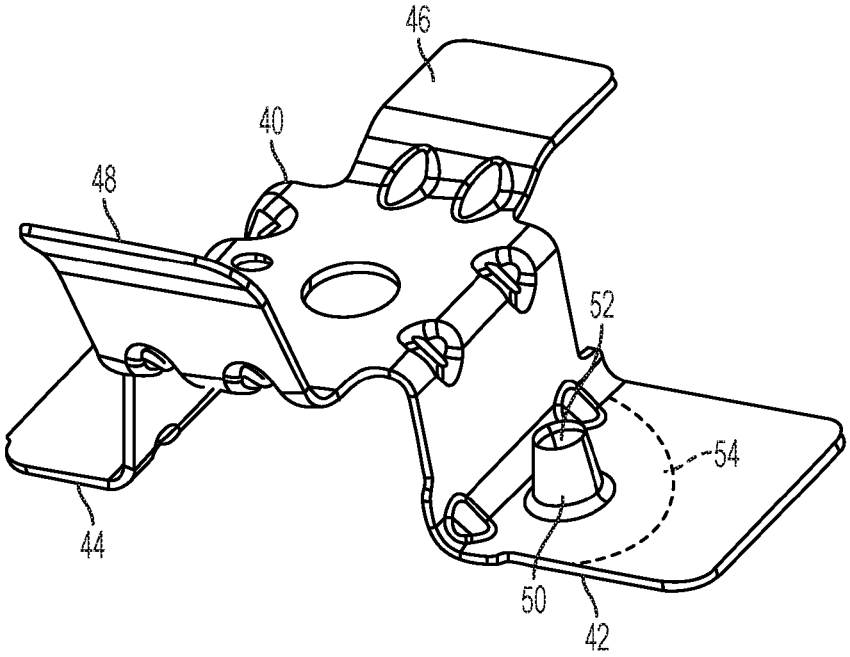
FIG. 5 is a front perspective view of a floor pan reinforcement component that may be produced according to the disclosed methods.
Figure 6:
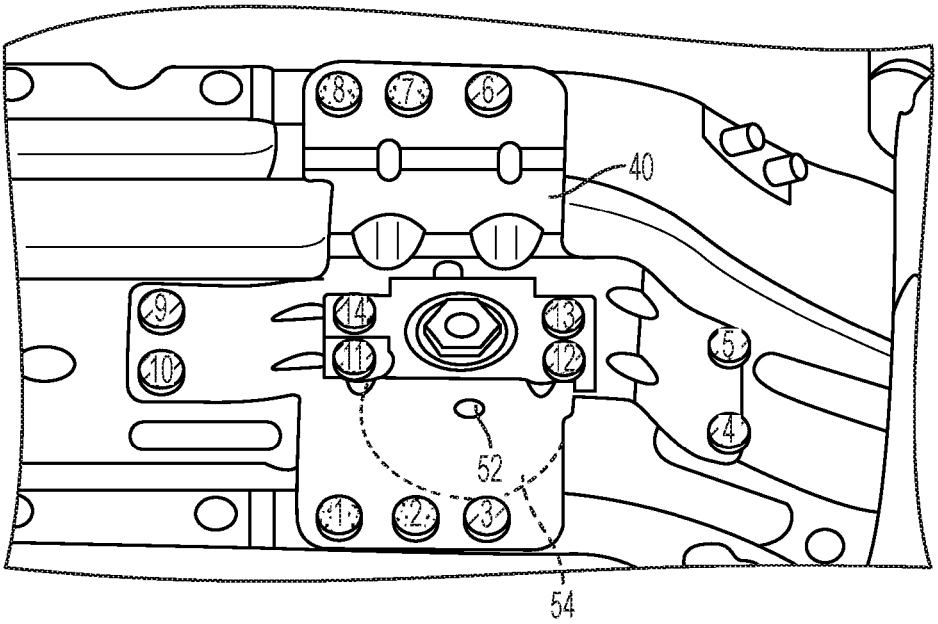
FIG. 6 is a rear perspective view of the floor pan reinforcement component of FIG. 5 attached to another vehicle component.

With reference to FIGS. 3-6, examples of two components having multiple, non-coplanar mating surfaces are shown. A side door latch reinforcement 30 is shown in FIGS. 3 and 4. The side door latch reinforcement 30 has multiple mating surfaces 32, 34, and 36, which are non-coplanar. A floor pan reinforcement 40 is shown in FIGS. 5 and 6. The floor pan reinforcement 40 has multiple mating surfaces 42, 44, 46, and 48. The components 30 and 40 may each include one or more forged protrusions 50. The forged protrusions 50 may be generally frusto-conical in shape, having a larger diameter at the base (e.g., at one of the mating surfaces) that narrows at the protrusion 50 extends outward (e.g., away from the mating surface). The protrusion 50 may be hollow, having a bore or channel 52 therein. The protrusions 50 may be configured to receive a fastener (e.g., in the bore 52). However, while the protrusion 50 is shown as frusto-conical, the shape is not intended to be limiting and may be any shape extending away from a surface (e.g., mating surface) of the component.

The protrusions 50 may be formed by repeated forging operations, as described above. For example, multiple, progressive dies may be used to incrementally increase the length and/or width of the protrusion or to increase the diameter of the bore 52. The forging operation may generate increased levels of stress and/or strain in the material in the protrusions 50, as well as in a surrounding region of the protrusion, which may be referred to as the forging region 54. The forging region 54 may therefore have higher levels of internal stress/strain than regions that are remote from the protrusion 50. In one embodiment, the material in the forging region 54 may have undergone strain of at least 50%, 100%, or 200% of the elongation or elastic limit of the material (e.g., 1.5×, 2×, or 3× the elongation/elastic limit). The material outside of the forging region 54 (e.g., the remaining bulk) may have undergone little or no strain or strain that is within the elongation/elastic limit. The forging region 54 may surround the protrusion 50 and may have a shape corresponding to the shape of the protrusion 50. For example, the protrusion 50 is shown as having a generally frusto-conical shape (e.g., circular cross-section), therefore, the forging region 54 may be generally circular and concentric with the protrusion 50. However, the size and shape of the forging region 54 may depend on other features of the component and the specifics of the forging operation. Therefore, the forging region 54 may have a shape different than that of the protrusion 50.

In manufacturing, particularly high-volume manufacturing (e.g., vehicles), it may be advantageous to remove or eliminate steps in the production cycle to reduce costs and/or save time. For example, it may be beneficial to eliminate the solution heat treatment step 16 and the quenching step 18 from the process 10. However, it has been discovered that eliminating these steps may require adjustments to other parts of the process, including the type of material used and/or the temper of the material used in the process.

Figure 7:
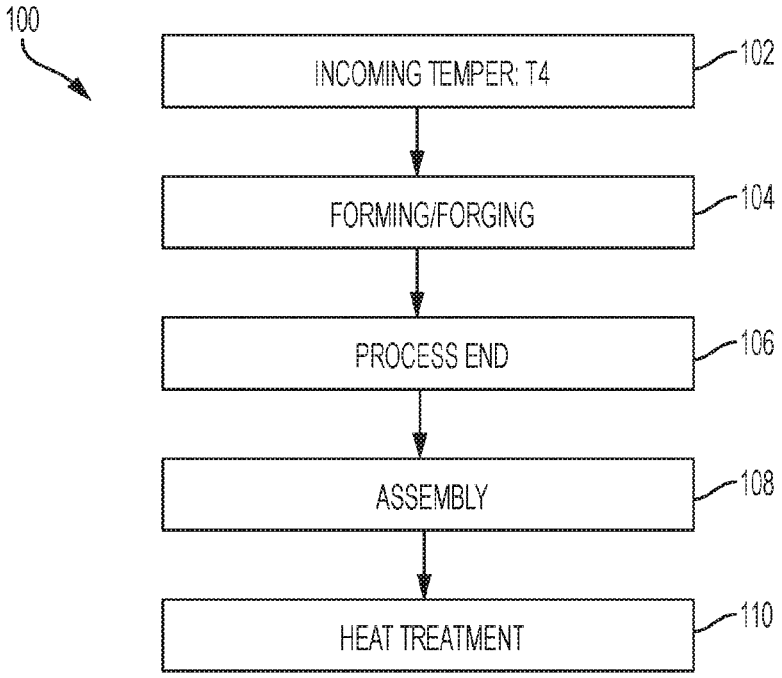
FIG. 7 is an example process flow for the forming and heat treating of an aluminum alloy component, according to an embodiment.
Figure 8:
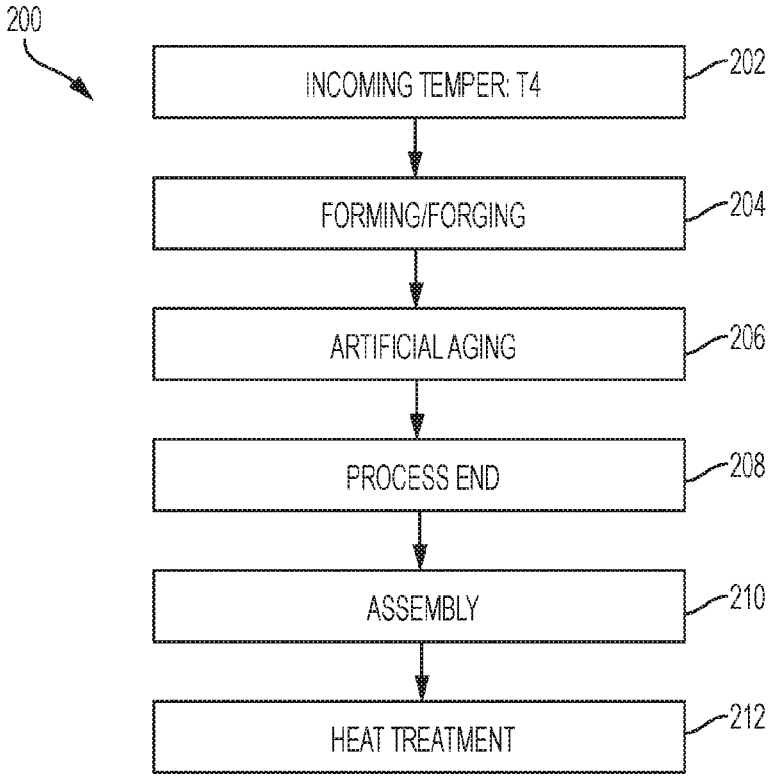
FIG. 8 is another example process flow for the forming and heat treating of an aluminum alloy component, according to an embodiment.

With reference to FIGS. 7 and 8, two flowcharts are shown for production processes that eliminate the solution heat treatment step 16 and the quenching step 18 from the process 10. In flowchart 100, the first step 102 starts with receiving a sheet of 6xxx series aluminum alloy that has been solutionized (by a solution heat treatment), quenched, and aged hardened (e.g., naturally or artificially aged). For example, the sheet may have a T4 or T4+ temper, which may be a result of natural or artificial aging. In one embodiment, the sheet may have an average yield strength of at least 100 MPa, 125 MPa, or 150 MPa. In step 104, the T4 temper aluminum sheet may be formed, for example by forging. The forming step may include any metal shaping process. As described above, the shaping process may include the use of progressive dies to incrementally shape the component to a final shape. The forming step may form components having a forged protrusion, such as those shown and described with respect to FIGS. 3-6.

Accordingly, compared to process 10, the forming step 104 may be performed on an aluminum sheet having a much different temper than forming step 14. In process 10, the forming step 14 is performed on an annealed aluminum sheet, which generally has significantly lower strength (e.g., yield strength) and is more ductile and easier to shape. In order to perform the forming step 104 on a T4 temper Al sheet, it has been found that it may be important to use certain aluminum alloys (described in more detail below). For example, a subset of 6111 alloys has been discovered to be formable in a T4 temper.

In step 106, the forming process may be completed, such that the components are in substantially their final form and shape. In step 108, the components formed by the process 100 may be assembled with other components, which may or may not have been formed according to process 100. In one embodiment, the components formed by process 100 may be vehicle components, and the assembly step 108 may include assembling the components with other components to form a vehicle or a portion of a vehicle. The assembly step 108 may also include painting at least a portion of the assembled vehicle. For example, one or more components of the assembled vehicle may be painted or the entire assembled vehicle may be painted. As used herein, the assembled vehicle may not necessarily be a completed vehicle, some components may be added to vehicle later and may be painted separately. In one embodiment, the assembled vehicle may include the body of the vehicle or at least the body of the vehicle.

Vehicle painting may include multiple steps or coats. The first step or coat may be an electrocoat, or E-coat. The E-coat may be a protective coating that prevents or reduces corrosion. E-coats are relatively common in current vehicles, but not necessary. The E-coat may be applied in lieu of, or in addition to, a primer coat. After the E-coat (if present), a color or base coat may be applied. The base coat generally includes the pigment(s) that give the overall paint its color and may also include any flakes or other additions to change the aesthetics of the paint. A clear coat may be applied after the base coat. The clear coat is generally transparent and may have a glossy finish. The clear coat typically also serves a protective function, resisting abrasion and UV light, for example. Each of the coats may have a corresponding heat treatment to cure the layer before the next layer is applied. In some painting systems, two or more of the above coating steps may be combined. Accordingly, there may be one or more heat treatments (paint bake cycles) to cure the painted vehicle assembly, for example, 2 to 4 heat treatments may be included in the overall paint bake process.

In step 110, the component(s) formed in step 104, along with other components in the assembly formed in step 108, may be heat treated. This heat treatment may be a known as a paint bake heat treatment that evaporates solvents in the paint and at least partially cures the paint. It has been discovered that a paint bake heat treatment may artificially age the components formed in step 104 to increase their strength (e.g., yield strength) through precipitation hardening. The paint bake heat treatment may provide the components with a temper that is at or close to a T6 temper (peak aging). For example, the components may have an average yield strength throughout the component of at least 240 MPa, such as at least 250 MPa or at least 260 MPa. The paint bake heat treatment or treatments may be the only heat treatment(s) performed in the process 100. For example, no other heat treatments may be performed on the components prior to the painting process.

In one embodiment, the heat treatment 110 may be a single step heat treatment (e.g., the disclosed results are achieved in a single step, even if other steps are added). The temperature of the heat treatment may be from 160° C. to 200° C., or any sub-range therein, such as 170° C. to 190° C., 175° C. to 185° C., or about 180° C. As used herein, the temperatures stated may be the temperature of the oven or furnace used for the heat treatment, and does not necessarily correspond directly to the temperature of the component. The time of the heat treatment (e.g., exposure time) may be up to 40 or 45 minutes, for example, 10 to 40 minutes, 15 to 40 minutes, 15 to 30 minutes, 20 to 40 minutes, 20 to 35 minutes, or 20 to 30 minutes.

In another embodiment, the heat treatment 110 may be a multiple step heat treatment (e.g., a treatment including a hold time at two or more different temperatures). For example, if there are multiple paint coats (e.g., E-coat, base coat, and clear coat), there may be multiple heat treatment processes as part of the overall paint bake operation. In one embodiment, there may be from 2 to 4 separate heat treatments included in the paint bake process. Each heat treatment may be performed at a temperature from 130° C. to 220° C., or any sub-range therein, such as 140° C. to 210° C. Each heat treatment may have a duration of 5 to 45 minutes, or any sub-range therein, such as 10 to 40 minutes or 10 to 30 minutes. In one embodiment, the temperature may be held constant or substantially constant during and for the duration of each heat treatment. For example, the temperature may be kept at a target temperature ±5° C.

In one embodiment, the temperature of each heat treatment in the multiple heat treatments of the paint bake operation may decrease from the first cycle to the last cycle. The first heat treatment in the operation may be at a temperature of 170° C. to 220° C., or any sub-range therein, such as 170° C. to 210° C., 170° C. to 200° C., 170° C. to 190° C., 175° C. to 200° C., 175° C. to 185° C., about 180° C. (e.g., ±3° C.) or others. The remaining heat treatments (e.g., one, two, or three remaining) may be at a temperature of 130° C. to 170° C., or any sub-range therein, such as 135° C. to 165° C., 140° C. to 160° C., 130° C. to 150° C., 145° C. to 155° C., 135° C. to 150° C., about 150° C. (e.g., ±3° C.), about 143° C. (e.g., ±3° C.), or others. Each of the heat treatments may be from 5 to 40 minutes, or any sub-range therein, such as 5 to 35 minutes, 5 to 30 minutes, 10 to 40 minutes, 10 to 35 minutes, 15 to 40 minutes, 5 to 15 minutes, or about 10 minutes.

In one embodiment, there may be three heat treatments in the paint bake operation, for example, exactly three. One example of a 3-step paint bake operation may include a first heat treatment at a temperature of 170° C. to 190° C. for 5 to 15 minutes, a second heat treatment at a temperature of 140° C. to 160° C. for 5 to 15 minutes, and a third heat treatment at a temperature of 130° C. to 150° C. for 5 to 15 minutes. For example, the 3-step paint bake operation may include a first heat treatment at a temperature of about 180° C. for about 10 minutes (e.g., ±3 minutes), a second heat treatment at a temperature of 150° C. for about 10 minutes, and a third heat treatment at a temperature of 143° C. for about 10 minutes. In embodiments having exactly two heat treatments, the first heat treatment may be similar to the above first heat treatment and the second heat treatment may be similar to the above second or third heat treatment.

Accordingly, the process 100 may reduce the number of steps in the component processing path. In particular, the SHT and quenching steps may be eliminated from the processing path and may be completed prior to the process 100. For example, the SHT and quench may be completed by the material supplier or may be completed at a different location or at a different time that does not impact the timing of the process 100. The process 100 may also require less space and/or less equipment than processes requiring a SHT and quench (e.g., process 10). Process 100 may also take advantage of a paint bake heat treatment in order to finalize the strength of the components without needing an additional, separate heat treatment that is specifically for the components in process 100.

With reference to FIG. 8, a flowchart 200 is shown for another alternative processing path for 6xxx series Al alloy sheets. Steps 202 and 204 may be the same as steps 102 and 104 in process 100, and will therefore not be described again in detail. After the T4 temper Al alloy component has been shaped in steps 202 and 204, the component may be heat treated in step 206. The heat treatment in step 206 may be a different and separate heat treatment from any paint bake heat treatment that occurs later in the process (e.g., different than step 110). In one embodiment, the heat treatment 206 may be a single step heat treatment. The temperature of the heat treatment may be from 200° C. to 250° C., or any sub-range therein, such as 210° C. to 240° C., 215° C. to 235° C., 220° C. to 230° C., or about 225° C. The time of the heat treatment may be up to 45 or 50 minutes, for example, 15 to 45 minutes, 20 to 40 minutes, 25 to 40 minutes, 20 to 35 minutes, 25 to 35 minutes, or about 30 minutes.

The heat treatment in step 206 may provide the components with a temper that is at or close to a T6 temper (peak aging). In one embodiment, components formed by process 200 may have a higher average yield strength than components formed by process 100. For example, the components may have an average yield strength throughout the component of at least 300 MPa, such as at least 320 MPa or at least 340 MPa.

In step 208, the forming process may be completed, such that the components are in substantially their final form and shape. In step 210, the components formed by the process 200 may be assembled with other components, which may or may not have been formed according to process 200. In one embodiment, the components formed by process 200 may be vehicle components, and the assembly step 210 may include assembling the components with other components to form a vehicle or a portion of a vehicle. In step 212, the assembled components may undergo a heat treatment, which may be a paint bake heat treatment. This heat treatment may be similar to the heat treatment 110 in process 100, described above, however this is not required. The heat treatment in step 212 may be a single step or multiple step heat treatment. The paint bake heat treatment in step 212 may have a small or minor impact on the yield strength properties of the components formed by process 200. This may be because the components have already undergone an age hardening heat treatment in step 206 and therefore the relatively short time and low temperature paint bake heat treatment may not significantly change the properties of the components.

Accordingly, the process 200 may reduce the number of steps in the component processing path. In particular, the SHT and quenching steps may be eliminated from the processing path and may be completed prior to the process 200. For example, the SHT and quench may be completed by the material supplier or may be completed at a different location or at a different time that does not impact the timing of the process 200. The process 200 may also require less space and/or less equipment than processes requiring a SHT and quench (e.g., process 10). Process 200 still includes a separate artificial aging heat treatment, unlike process 100, however it may result in high strength components compared to process 100.

As described above, the components formed in processes 100 and 200 may include forged protrusions, for example, frusto-conical protrusions having a bore defined therein. These protrusions, as well as the immediately surrounding material, may have increased internal stress/strain compared to regions remote from the protrusions. During development of the processes 100 and 200 it was discovered that these higher and lower regions of stress/strain may lead to a strength gradient in the finished components such that the strength is higher in the forging region and lower in the remote (bulk) regions. This may be undesirable, for example, because it may result in inconsistent performance throughout the component or result in portions of the component being below a safety strength requirement.

The components formed in processes 100 and 200 may be made from a 6xxx series Al alloy. However, certain alloys may not be compatible with the processes. For example, 6061 aluminum may not be formable in a thermally treated temper (e.g., T4), or at least not formable to the extent necessary to form the disclosed forged protrusions. It was discovered that 6111 Al alloys were able to be formed to the extent necessary in the thermally treated temper to form the disclosed forged protrusions. But, as described above, it was found that in certain circumstances there was a significant gradient in yield strength between the forging regions surrounding the protrusions and the remaining bulk of the component. This challenge was unique to the developed processes 100 and 200 compared to process 10, likely due to factors such as the incoming O-temper and the solution heat treatment after forming in process 10.

It was discovered, however, that by narrowing the composition constraints on the 6111 alloy, a significant reduction in the yield strength gradient between the forged and bulk regions could be achieved after the disclosed heat treatments. As described above, 6111 has a composition profile of 0.5-1% magnesium, 0.6-1.1% silicon, 0.5-0.9% copper, 0.1-0.45% manganese, up to 0.4% iron, up to 0.15% zinc, up to 0.1% chromium, up to 0.1% titanium and other elements up to 0.05% each (0.15% total), all percentages by weight with the balance being aluminum. It has been discovered that the following composition profile may reduce the strength gradient: 0.55-0.95% magnesium, 0.55-0.95% silicon, 0.5-0.8% copper, up to 0.3% manganese up to 0.3% iron up to 0.1% zinc up to 0.1% chromium up to 0.1% titanium and other elements up to 0.05% each (0.15% total), all percentages by weight with the balance being aluminum. This composition profile has been engineered to ensure recycling by anyone making an alloy having this profile. Such a recycling capability is not guaranteed with the "typical" 6111 industry composition.

In at least one embodiment, the strength gradient between the forging region 54 (e.g., region immediately surrounding the forged protrusion 50) and the bulk region may be reduced such that an average yield strength of the bulk region may be within 40% of an average yield strength of the forging region. In another embodiment, the average yield strength of the bulk region may be within 30%, 25%, 20%, or 15% of the average yield strength of the forging region. For example, if the average yield strength of the forging region is 320 MPa and the average yield strength of the bulk region is 245 MPa, the bulk region is within 25% of the forging region (245/320=76.6%). In some embodiments, the strength gradient between the forging region(s) and the bulk region may be even smaller, or non-existent, when the process 200 is used. In one embodiment, the average yield strength of the bulk region may be within 15%, 10%, or 5% of the average yield strength of the forging region. For example, if the average yield strength of the forging region is 350 MPa and the average yield strength of the bulk region is 325 MPa, the bulk region is within 10% of the forging region (325/350=92.9%).

As described above, the processes 100 and 200 may increase the overall average yield strength of the components, including the average yield strength in the forging region(s) and in the bulk region. In one embodiment, the average yield strength of the bulk region may be at least 240 MPa, 250 MPa, or 260 MPa after the heat treatment 110 in the process 100. In another embodiment, the average yield strength of the forging region may be at least 260 MPa, 280 MPa, 300 MPa, or 320 MPa after the heat treatment 110 in the process 100.

In some embodiments, the process 200 may produce higher average yield strengths in the forming and bulk regions than the process 100. In one embodiment, the average yield strength of the bulk region may be at least 300 MPa, 320 MPa, or 340 MPa after the artificial aging heat treatment 206 in the process 200 (and after heat treatment 212). In another embodiment, the average yield strength of the forging region may be at least 300 MPa, 320 MPa, or 340 MPa after the artificial aging heat treatment 206 in the process 200 (and after heat treatment 212). Accordingly, both the bulk and forging regions may have a similar average yield strength and may both be at least 300 MPa, 320 MPa, or 340 MPa.

With reference to FIGS. 9 and 10, experimental hardness and strength data is shown for a component formed according to process 10 (column/row 1), the first two steps of processes 100/200 (column/row 2), process 100 (column/row 3), and process 200 (column/row 4). FIG. 9 is a table showing the hardness/yield strength data for 10 locations, which correspond to the locations shown in FIG. 6. Locations 1-3 are near the forged protrusion and are therefore considered to be in or near the forging region, as described above. Locations 4-10 are remote from the forged protrusion and are therefore considered to be in the bulk region. Average hardness values and yield strength values are shown for each location for each of the four processes.

As shown in the first set of columns, the component formed according to process 10 shows only a minor difference between the two regions. As described above, this may be due to the difference in processing, particularly the additional heat treatment (SHT) included in process 10 and the different starting temper (O vs. T (e.g., T4)). The second set of columns shows the strength data for a component formed of the narrowed 6111 alloy composition but only through the forming step (e.g., progressive forging). As shown, the average strength in the forging region is substantially greater than the strength in the bulk region. In addition, the strength in the bulk region is lower than that of the component formed by process 10.

The third and fourth set of columns show the properties of components formed by processes 100 and 200, respectively. The components in both processes were made of the narrowed 6111 alloy composition. In the third set of columns, corresponding to process 100, it can be seen that the average yield strength in the forging region is increased compared to column two. In addition, the average yield strength of the bulk region is increased to an even greater degree, almost reaching the level of the forging region in column two. There is still a gradient in the third column, but it is substantially less than that of the non-heat treated component in column two (a 25.2% increase compared to a 56.1% increase). Furthermore, the average yield strength overall (all ten points), increased substantially from column two to column three (33.8%).

In the fourth set of columns, corresponding to process 200, it can be seen that the average yield strength in the forging region is increased compared to columns two and three. In addition, the average yield strength of the bulk region is increased to an even greater degree than in column 3, surpassing the level of the forging region in columns two and three. There is still a very slight gradient in the fourth column, but it is substantially less than that of the gradients in column two or three (2.9% increase, compared to 56.1% and 25.2%, respectively). Furthermore, the average yield strength overall (all ten points) for column four is substantially greater than columns two and three (65.7% and 23.8%, respectively).

Accordingly, the heat treatments in both process 100 and process 200 reduced the gradient in yield strength compared to the formed component of T4 Al alloy sheet. In addition, both processes produced a component having far superior strength throughout the component than the process 10. Processes 100 and 200 therefore result in superior components, from a yield strength perspective, and also reduce the number of steps in the process—thereby saving time and reducing costs. Process 200 resulted in a higher average strength and a reduced strength gradient compared to process 100, but process 100 still provides a benefit over process 100 and has the most streamlined process flow.

With reference to FIG. 10, average hardness and yield strength data is shown comparing the forged protrusion to the surrounding regions. The first set of columns corresponds to data points on the forged protrusion itself, while the second set of columns corresponds to an average of the ten data points described above and shown in FIG. 6 (e.g., the forging region and the bulk region). The first row corresponds to a component formed by process 10. As shown in the table, there is very little difference between the average yield strength of the protrusion and the remainder of the component. As described above, this is likely due to the temper of the material and the solution heat treatment step.

The second row corresponds to the component formed in a T4 temper but not heat treated. As shown, the average yield strength of the protrusion is substantially higher than the remaining bulk, resulting in a very large gradient between the two (62.9%). The third row corresponds to a component formed according to process 100. The data shows that a gradient still exists between the protrusion and the remaining bulk, but that it is substantially less than for row two (30.2%). In addition, the average yield strengths are higher than in row two for both the protrusion and the remaining bulk. The fourth row corresponds to a component formed according to process 200. The data shows that there is very little gradient between the two regions sampled. In fact, the protrusion shows a slight decrease in average yield strength (2.6%). The average yield strength of the remaining bulk region is substantially higher in row four compared to row three. Accordingly, the data in FIG. 10 further shows that processes 100 and 200 both reduce the yield strength gradient compared to the as-formed component and that both processes result in higher average yield strength compared to process 10. Process 200 is again more uniform and results in a higher average yield strength than process 100.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A method, comprising:

forming a sheet of solution heat-treated, quenched, and aged 6xxx series aluminum having a sheet average yield strength of at least 100 MPa into a component;

attaching the component to an assembly;

painting at least a portion of the assembly; and heat treating the assembly to cure the paint and to increase a component average yield to at least 240 MPa, the heat treating step consists of a first heat treatment at a temperature of 170° C. to 190° C. for 5 to 15 minutes, followed by a second heat treatment at a temperature of 140° C. to 160° C. for 5 to 15 minutes, followed by a third heat treatment at a temperature of 130° C. to 150° C. for 5 to 15 minutes.

2. The method of claim 1, wherein the sheet has a T4 temper.

3. The method of claim 1, wherein the forming step includes a progressive forging operation using multiple dies.

4. The method of claim 3, wherein the progressive forging operation forms a forged protrusion in the component and creates a forging region surrounding the forged protrusion, the forging region being strained more than a bulk region of the component during the progressive forging.

5. The method of claim 4, wherein the forged protrusion is frusto-conical and the forging region is a circle concentric with the frusto-conical forged protrusion.

6. The method of claim 4, wherein the heat treating step increases an average yield strength of the forging region and the bulk region and reduces a strength gradient therebetween.

7. The method of claim 6, wherein the heat treating step increases an average yield strength of the bulk region by a greater amount than the forging region.

8. The method of claim 1, wherein each of the first, second and third heat treatments is carried out at an oven temperature varying by only ±5° C. during an entire duration of each heat treatment.

9. The method of claim 1, wherein the 6xxx series aluminum has a composition profile including:

0.55-0.95 wt. % magnesium;

0.55-0.95 wt. % silicon;

0.5-0.8 wt. % copper;

up to 0.3 wt. % manganese;

up to 0.3 wt. % iron;

up to 0.1 wt. % zinc;

up to 0.1 wt. % chromium; and up to 0.1 wt. % titanium.

10. The method of claim 1, wherein there are no additional artificial aging heat treatments between the forming step and the painting step.

11. A method, comprising:

progressively forging a sheet of T4-tempered 6xxx series aluminum into a component including a forged protrusion and a surrounding forging region; and heat treating the component to increase an average yield strength of the forging region and an average yield strength of a bulk region of the component and to reduce a strength gradient therebetween, the component having an average yield strength of at least 240 MPa after heat treating, the heat treating step consists of a first heat treatment at a temperature of 170° C. to 190° C. for 5 to 15 minutes, followed by a second heat treatment at a temperature of 140° C. to 160° C. for 5 to 15 minutes, followed by a third heat treatment at a temperature of 130° C. to 150° C. for 5 to 15 minutes.

12. The method of claim 11, wherein each of the first, second and third heat treatments is carried out at an oven temperature varying by only ±5° C. during an entire duration of each heat treatment.

13. The method of claim 11, wherein there are no additional artificial aging heat treatments between the forging step and the heat treating step.

14. The method of claim 11, wherein the progressive forging step includes using multiple dies.

15. The method of claim 11, wherein the surrounding forging region being strained more than a bulk region of the component during the progressive forging.

16. The method of claim 15, wherein the average yield strength of the bulk region is within 15% of the average yield strength of the forging region.

17. The method of claim 15, wherein the average yield strength of the bulk region is within 5% of the average yield strength of the forging region.

18. The method of claim 11, wherein the forged protrusion is frusto-conical.

19. The method of claim 18, wherein the surrounding forging region is a circle concentric with the frusto-conical forged protrusion.

20. The method of claim 11, wherein the 6xxx series aluminum has a composition profile including:

0.55-0.95 wt. % magnesium;

0.55-0.95 wt. % silicon;

0.5-0.8 wt. % copper;

up to 0.3 wt. % manganese;

up to 0.3 wt. % iron;

up to 0.1 wt. % zinc;

up to 0.1 wt. % chromium; and up to 0.1 wt. % titanium.

* * * * *